US009144355B2

(12) United States Patent
Jang et al.

(10) Patent No.: US 9,144,355 B2
(45) Date of Patent: Sep. 29, 2015

(54) AUTOMATIC CLEANER

(75) Inventors: Jaewon Jang, Changwon-si (KR); Dongmyung Shin, Changwon-si (KR)

(73) Assignee: LG Electronics Inc., Seoul (KR)

( * ) Notice: Subject to any disclaimer, the term of this patent is extended or adjusted under 35 U.S.C. 154(b) by 879 days.

(21) Appl. No.: 13/352,565

(22) Filed: Jan. 18, 2012

(65) Prior Publication Data

US 2012/0180251 A1 Jul. 19, 2012

(30) Foreign Application Priority Data

Jan. 19, 2011 (KR) ..... 10-2011-0005283

(51) Int. Cl.
*A47L 9/28* (2006.01)
*A47L 9/00* (2006.01)

(52) U.S. Cl.
CPC ..... *A47L 9/009* (2013.01); *A47L 2201/04* (2013.01)

(58) Field of Classification Search
CPC ..... A47L 5/00; A47L 9/009; A47L 9/2805; A47L 2201/04
USPC ..... 15/319, 325, 339
IPC ..... A47L 9/28
See application file for complete search history.

(56) References Cited

U.S. PATENT DOCUMENTS 6,481,515 B1 * 11/2002 Kirkpatrick et al. ..... 180/65.1

FOREIGN PATENT DOCUMENTS

KR 10-2004-0096252 A 11/2004

OTHER PUBLICATIONS

Korean Office Action dated Sep. 28, 2012 issued in Application No. 10-2011-0005283.

* cited by examiner

*Primary Examiner* — David Redding
(74) *Attorney, Agent, or Firm* — Ked & Associates, LLP

(57) ABSTRACT

Provided is an automatic cleaner that absorbs and senses a shock more efficiently. In one embodiment, an automatic cleaner comprises: a casing comprising a cover that defines a top surface thereof and at least one portion of an edge thereof, and a base that defines a bottom surface thereof, the cover being coupled to the base and moved relative to the base; a sensing member installed on one of the cover and the base, and sensing a relative movement of the cover to the base; a driving part installed on the other of the cover and the base, and operating the sensing member according to the relative movement of the cover to the base; and a buffer member installed on one of the cover and the base, and absorbing a shock according to the relative movement of the cover to the base.

19 Claims, 6 Drawing Sheets

AUTOMATIC CLEANER

CROSS-REFERENCE TO RELATED APPLICATIONS

The present application claims priority under 35 U.S.C. 119 and 35 U.S.C. 365 to Korean Patent Application No. 10-2011-0005283 (filed on Jan. 19, 2011), which is hereby incorporated by reference in its entirety.

BACKGROUND

The present disclosure relates to an automatic cleaner.

Cleaners may suck and remove a foreign substance from a floor. Recently, automatic cleaners for performing an automatic cleaning operation are introduced. Automatic cleaners are moved by driving force of a motor to suck and remove a foreign substance from a floor.

Such an automatic cleaner includes a bumper for absorbing a shock, and a sensor for sensing a shock. The bumper absorbs a shock generated when the automatic cleaner collides with an obstacle such as a wall. The sensor senses a movement of the bumper absorbing the shock, so as to substantially sense the obstacle.

However, such automatic cleaners have the following limitations.

First, automatic cleaners include a bumper for absorbing a shock, and an elastic member for elastically supporting the bumper. Thus, the number of components is substantially increased, and manufacturing processes are complicated.

Elastic force of the bumper is increased to improve shock absorbing efficiency. To this end, for example, the bumper may include an elastic member having a high coefficient of elasticity. In this case, as elastic force of the bumper is increased, shock sensing efficiency of a sensor may be degraded.

In addition, since the bumper is disposed on the exterior of the cleaner, exterior and aesthetic quality of the cleaner may be degraded.

SUMMARY

Embodiments provide an automatic cleaner having a simpler configuration.

Embodiments also provide an automatic cleaner that efficiently absorbs and senses a shock.

Embodiments also provide an automatic cleaner that makes is possible to increase the degree of design freedom, and aesthetic quality.

In one embodiment, an automatic cleaner comprises: a casing comprising a cover that defines a top surface thereof and at least one portion of an edge thereof, and a base that defines a bottom surface thereof, the cover being coupled to the base and moved relative to the base; a sensing member installed on one of the cover and the base, and sensing a relative movement of the cover to the base; a driving part installed on the other of the cover and the base, and operating the sensing member according to the relative movement of the cover to the base; and a buffer member installed on one of the cover and the base, and absorbing a shock according to the relative movement of the cover to the base.

In another embodiment, an automatic cleaner comprises: a cover defining a top surface thereof and one portion of an edge thereof; a base coupled to the cover, and defining a bottom surface thereof and the other portion of the edge; a plurality of driving parts on the cover; a plurality of shock transmitters disposed on the cover, and farther away from an edge of the cover and the base than the driving part is; a plurality of sensing member installation parts disposed on the base, the number of the sensing member installation parts being equal to the number of the driving parts; a plurality of buffer member installation parts disposed on the base, the number of the buffer member installation parts being equal to the number of the shock transmitters; a plurality of sensing members installed on the sensing member installation parts, respectively, and turned on/off by the driving parts; and a buffer member installed on the buffer member installation part, and absorbing a shock transmitted by the shock transmitter, wherein, when the cover is moved relative to the base by an external shock, the driving part turns the sensing member on/off, and the buffer member absorbs the shock from the shock transmitter.

In another embodiment, an automatic cleaner comprises: a cover defining a top surface thereof and one portion of an edge thereof; a base coupled to the cover, and defining a bottom surface thereof and the other portion of the edge; a sensing member sensing a relative movement of the cover to the base; and a buffer member absorbing a shock generated by the relative movement.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
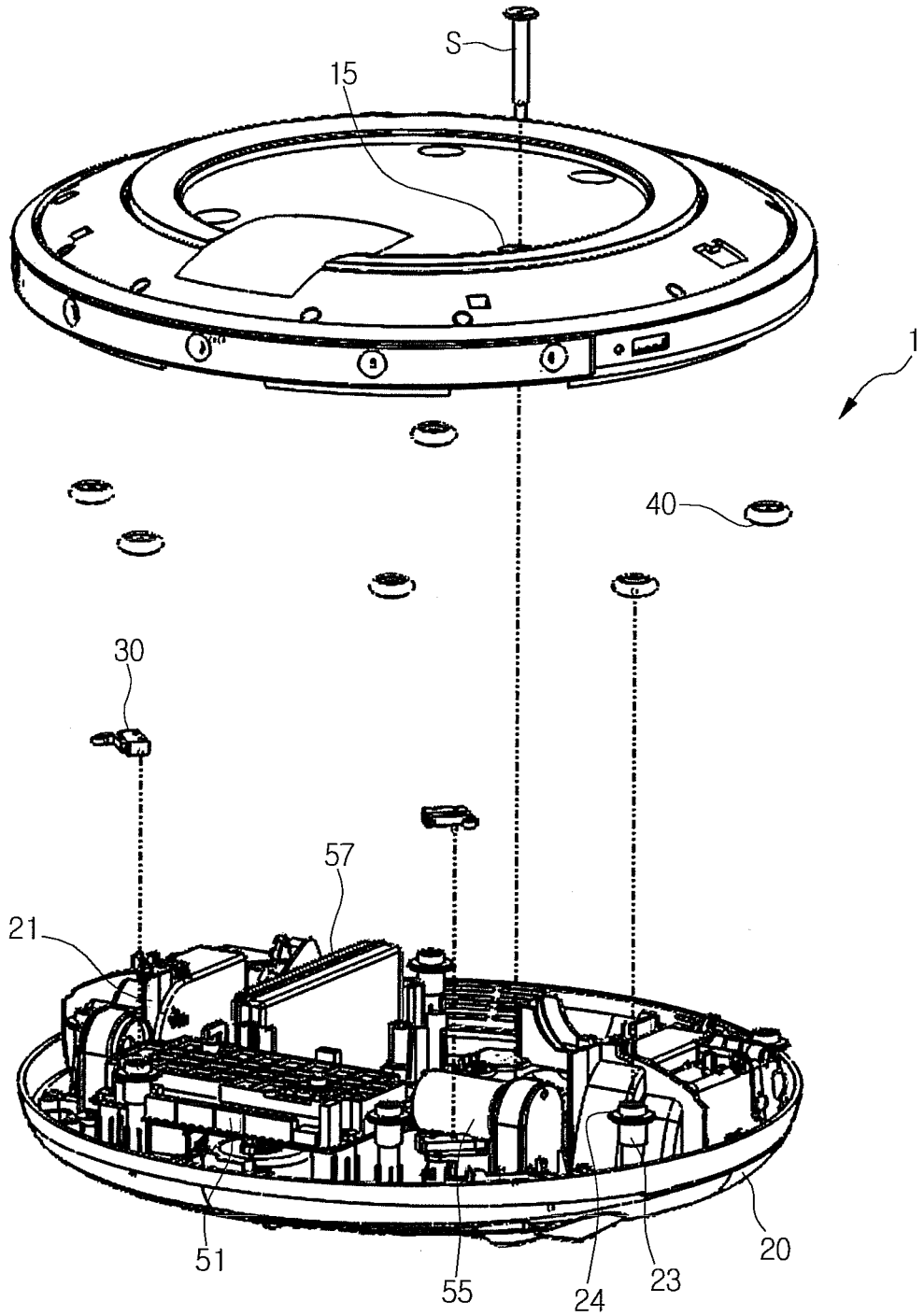
FIG. 1 is an exploded perspective view illustrating an automatic cleaner according to a first embodiment.
Figure 2:
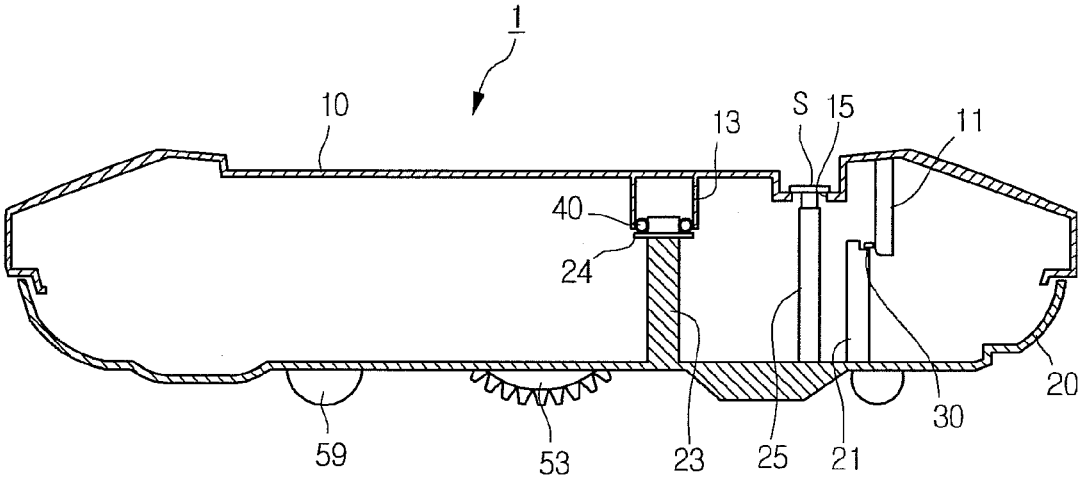
FIG. 2 is a vertical cross-sectional view illustrating an automatic cleaner according to the first embodiment.

FIG. 1 is an exploded perspective view illustrating an automatic cleaner according to a first embodiment. FIG. 2 is a vertical cross-sectional view illustrating an automatic cleaner according to the first embodiment.

Referring to FIGS. 1 and 2, the appearance of a vacuum cleaner 1 (hereinafter, referred to as a 'cleaner' for convenience in description) is defined by casings 10 and 20. The casings 10 and 20 have a flat cylindrical shape with a certain thickness, as a whole. The casings 10 and 20 include a cover 10 and a base 20.

The cover 10 defines the top appearance of the cleaner 1 and a portion of the edge thereof. The base 20 defines the bottom surface of the cleaner 1 and the other portion of the edge thereof. Each of the cover 10 and the base 20 has a circular plate shape with its edge bent downward or upward. At least the edge of the cover 10 further protrudes outward than that of the base 20. Thus, external force applied to the cleaner 1, that is, a shock is substantially applied to the cover 10. A space for storing various parts of the cleaner 1 is defined between the cover 10 and the base 20.

In more detail, referring to FIG. 2, driving parts 11 are disposed on the bottom surface of the cover 10. The driving parts 11 drive sensing members 30 to be described later. The driving part 11 extends downward from the bottom surface of the cover 10. The driving part 11 is closer to the edge of the cleaner 1 than to the center of the cover 10 and the base 20.

Shock transmitters 13 are disposed on the bottom surface of the cover 10. The shock transmitters 13 transmit a shock applied to the cover 10 to buffer members 40 to be described later. Substantially, the shock transmitters 13 selectively press the buffer members 40 according to a relative movement of the cover 10 to the base 20.

The shock transmitters 13 are closer to the center of the cover 10 at least than the driving parts 11 are. The shock transmitters 13 have a hollow cylindrical shape, and extend downward from the bottom surface of the cover 10. However, the shape of the shock transmitters 13 is not limited thereto. Furthermore, the shock transmitters 13 may confine the horizontal movement of the buffer members 40.

The cover 10 is provided with coupling holes 15. Couplers S for coupling the cover 10 to the base 20 pass through the coupling holes 15. The coupling holes 15 have a diameter that is greater than that of the couplers S. Accordingly, the cover 10 is allowed to move horizontally relative to the base 20. Particularly, the cover 10 is allowed to move horizontally relative to the base 20 by the difference between the diameter of the coupling holes 15 and the diameter of the couplers S.

Referring to FIGS. 1 and 2, various parts for substantially operating the cleaner 1 are installed on the top surface of the base 20. For example, a part for sucking and collecting a foreign substance, or a part for moving the cleaner 1 may be installed on the top surface of the base 20.

Sensing member installation parts 21 are installed on the top surface of the base 20. The number of the sensing member installation parts 21 is equal to the number of the driving parts 11. The sensing member installation parts 21 extend upward from the top surface of the base 20. When the cover 10 and the base 20 are assembled, at least one portion of the sensing member installation part 21 horizontally overlaps the driving part 11.

When the cover 10 and the base 20 are assembled, the sensing member installation parts 21 are spaced apart from the driving parts 11 toward the center of the cover 10 and the base 20. In other words, the driving parts 11 and the sensing member installation parts 21 are disposed on respective virtual lines passing through the center of the cover 10 and the base 20. The driving parts 11 are farther away from the center of the cover 10 and the base 20 than the sensing member installation parts 21 are. A distance between the driving part 11 and the sensing member installation part 21 is determined within a certain range. Accordingly, only when an external shock is applied to the sensing member 30 installed on the sensing member installation part 21, the sensing member 30 is driven by the driving part 11.

Buffer member installation parts 23 are installed on the top surface of the base 20. The buffer member installation parts 23 extend upward from the top surface of the base 20. The buffer members 40 are installed on the buffer member installation parts 23. The number of the buffer member installation parts 23 is equal to the number of the shock transmitters 13. When the cover 10 and the base 20 are assembled, the buffer member installation parts 23 are disposed at the vertical lower sides of the shock transmitters 13.

The buffer member installation parts 23 have a cylindrical shape. When the cover 10 and the base 20 are assembled, at least one portion of the buffer member installation part 23 horizontally overlaps the shock transmitter 13. The buffer members 40 are fitted on the upper ends of the buffer member installation parts 23. Thus, substantially, the buffer member installation parts 23 confine the horizontal movement of the buffer members 40. Buffer member support brackets 24 are installed on the upper ends of the buffer member installation parts 23. The buffer member support brackets 24 support the bottom surfaces of the buffer members 40 installed on the buffer member installation parts 23, and confine the downward movement of the buffer members 40.

Coupling bosses 25 are disposed on the top surface of the base 20. The couplers S passing through the coupling holes 15 couple to the coupling bosses 25. Thus, when the cover 10 and the base 20 are assembled, the coupling bosses 25 are disposed at the vertical lower sides of the coupling holes 15.

The sensing members 30 are installed on the sensing member installation parts 21, respectively. The sensing members 30 sense a shock applied to the cleaner 1, substantially, to the cover 10. Switches are used as the sensing members 30, which are turned on/off according to whether a shock is applied to the cover 10.

Particularly, the sensing members 30 are turned off unless a shock is applied to the cover 10. When the cover 10 is moved relative to the base 20 by a shock applied to the cover 10, the sensing members 30 are pressed by the driving parts 11, and thus are turned on. To this end, the sensing members 30 are disposed at portions of the sensing member installation parts 21 to horizontally overlap the driving parts 11.

The buffer members 40 are installed on the buffer member installation parts 23, respectively. The buffer members 40 absorb a shock applied to the cover 10. Substantially, the buffer members 40 absorb a shock caused by a relative movement of the cover 10 to the base 20.

The buffer members 40 are formed of an elastically deformable and flexible material. The buffer members 40 are fitted on the upper ends of the buffer member installation parts 23 horizontally overlapping the shock transmitters 13. Accordingly, when the buffer members 40 are installed on the buffer member installation parts 23, at least one portion of the outer circumferential surface of the buffer members 40 horizontally overlaps the shock transmitter 13. In this state, the bottom surface of the buffer members 40 is supported by the buffer member support bracket 24. Thus, when being installed on the buffer member installation parts 23, the buffer members 40 are confined at least in the horizontal and downward movements.

The buffer members 40 have an approximately ring shape. The outer diameter of the buffer members 40 is equal to or smaller than the inner diameter of the shock transmitters 13. The inner diameter of the buffer members 40 is equal to or greater than the outer diameter of the buffer member installation parts 23. Thus, when being installed on the buffer member installation parts 23, the buffer members 40 are in contact with or spaced apart from the shock transmitters 13 and the buffer member installation parts 23. Thus, the above-described sizes of the outer and inner diameters of the buffer members 40 make it possible to prevent the buffer members 40 from being elastically deformed when a shock is not applied to the cover 10, thereby substantially preventing a decrease of a shock absorption amount of the buffer members 40.

The cleaner 1 includes a control board 51, an agitator 53, a driving part 55, a battery 57, and a castor 59. Various electric parts for operating the cleaner 1 are installed on the control board 51. The agitator 53 removes a foreign substance from a floor. The driving part 55 generates driving force for operating the agitator 53. The battery 57 provides power for operating the cleaner 1. The castor 59 functions as an auxiliary wheel for moving and balancing the cleaner 1.

Hereinafter, an operation of an automatic cleaner according to the first embodiment will now be described with reference to the accompanying drawings.

Figure 3:
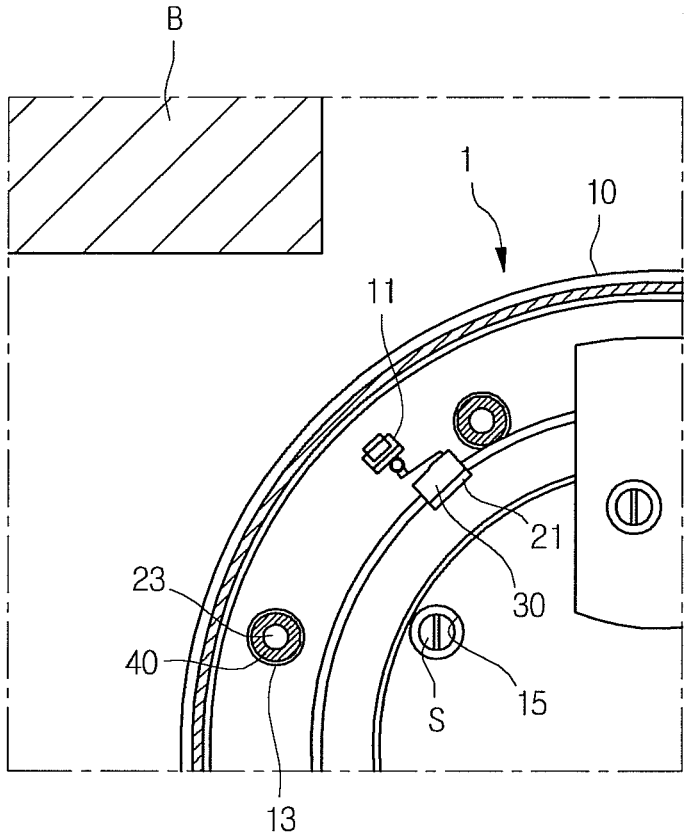
FIGS. 3 and 4 are schematic views illustrating a process in which an automatic cleaner absorbs and senses a shock according to the first embodiment.
Figure 4:
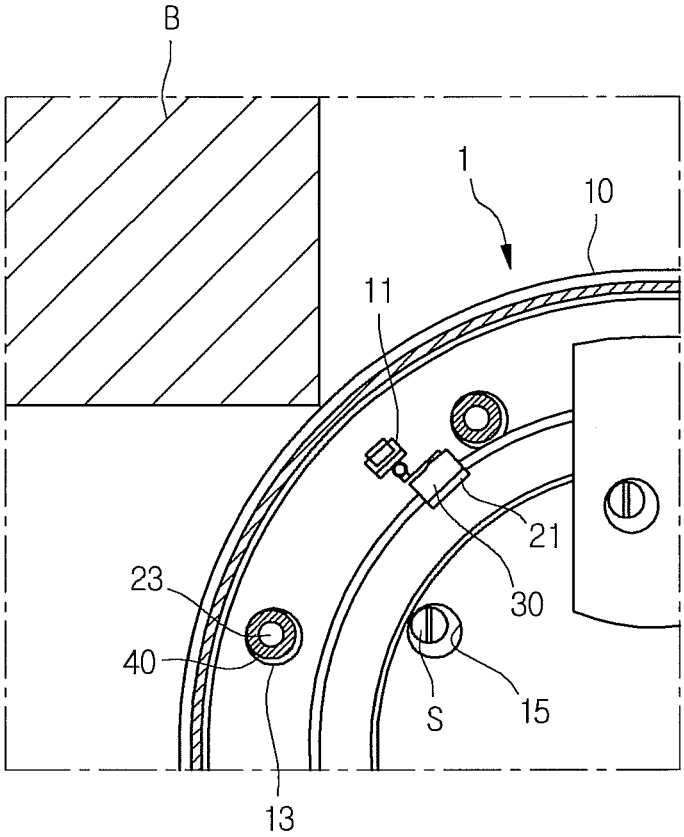

FIGS. 3 and 4 are schematic views illustrating a process in which an automatic cleaner absorbs and senses a shock according to the first embodiment.

Referring to FIG. 3, unless a shock is applied the cleaner 1, that is, to the cover 10, the driving part 11 is spaced apart from the sensing member 30. Accordingly, the sensing member 30 is maintained in an off state. In this state, it may be determined that there is no shock applied to the cover 10, that is, at least the cleaner 1 does not collide with an obstacle B on a moving path of the cleaner 1. Thus, for example, the cleaner 1 may continually move in a moving direction thereof.

When there is no shock applied to the cover 10, the outer circumferential surface of the buffer member 40 is in contact with or spaced apart from the inner circumferential surface of the shock transmitter 13. That is, the buffer member 40 is not deformed elastically.

Referring to FIG. 4, when a shock is applied to the cover 10, that is, when the cleaner 1 collides with the obstacle B, the cover 10 is moved relative to the base 20 by the obstacle B. At this point, since the cleaner 1 has an approximately flat cylindrical shape, the cover 10 is substantially moved in a radial direction of the cleaner 1 by the shock.

Also, the driving part 11 is moved in the radial direction. Accordingly, the sensing member 30 is turned on by the driving part 11. This state is determined as that the obstacle B is present on the moving path of the cleaner 1. Thus, for example, the cleaner 1 may change the moving direction thereof.

When the cover 10 is moved relative to the base 20 by the shock, the shock transmitter 13 is also moved in the radial direction. Accordingly, the shock transmitter 13 presses the buffer member 40, and the buffer member 40 is elastically deformed to absorb the shock applied to the cover 10.

As such, a process of absorbing a shock applied to the cover 10 is substantially different from a process of sensing the shock. Thus, each process can be efficiently performed.

Hereinafter, an automatic cleaner according to a second embodiment will now be described with reference to the accompanying drawings.

Figure 5:
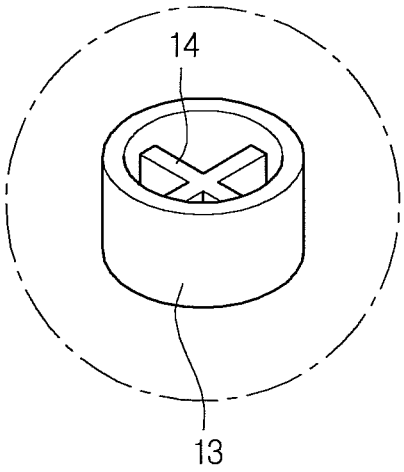
FIG. 5 is a perspective view illustrating a principal part of an automatic cleaner according to a second embodiment.
Figure 6:
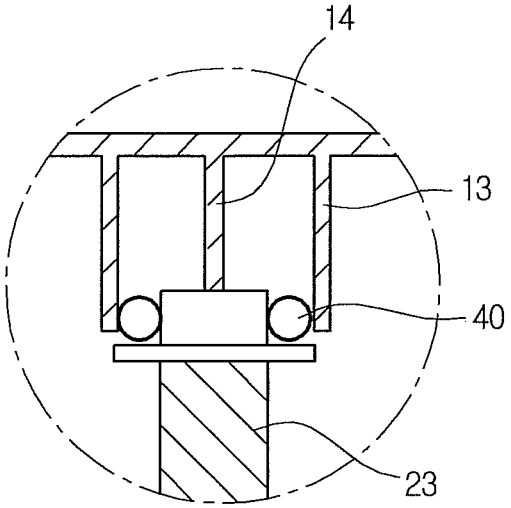
FIG. 6 is a vertical cross-sectional view illustrating the principal part of FIG. 5.

FIG. 5 is a perspective view illustrating a principal part of an automatic cleaner according to the second embodiment. FIG. 6 is a vertical cross-sectional view illustrating the principal part of FIG. 5. Like reference numerals denote like elements in the first and second embodiments, and a description of the same components as those of the first embodiment will be omitted in the second embodiment.

Referring to FIG. 5, a buffer member support rib 14 confines the upward movement of the buffer member 40 installed on the buffer member installation part 23. The buffer member support rib 14 extends downward from the bottom surface of the cover 10. Particularly, the buffer member support rib 14 is disposed on the bottom surface of the cover 10 within the shock transmitter 13.

The lower end of the buffer member support rib 14 contacts the top surface of the buffer member 40 installed on the buffer member installation part 23, thereby preventing the upward movement of the buffer member 40. The buffer member support rib 14 has an approximately cross shape in a horizontal cross-section, and is integrally formed with the shock transmitter 13. However, the buffer member support rib 14 may have any shape to contact the top surface of the buffer member 40.

Although the cover defines a portion of the edge of the cleaner, and the base defines the other portion of the edge of the cleaner, the present disclosure is not limited thereto. That is, the cover may define the entire edge of the cleaner.

Although the sensing member installation parts for installing the sensing members, and the buffer member installation parts for installing the buffer members are disposed on the base, they may be disposed on the cover. In this case, the driving parts and the shock transmitters may be disposed on the base.

According to the embodiment, buffer members and sensing members are disposed between a cover and a base to absorb and sense a shock, without a separate bumper. Accordingly, the cleaner can be more simplified.

In addition, a shock is transmitted to the buffer member and the sensing member through different members. Thus, a shock absorbing process and a shock sensing process can be efficiently performed without interference therebetween.

In addition, the cover and the base substantially define the appearance of the cleaner. Thus, the appearance is tidier, and can be more freely designed, thereby substantially improving aesthetic quality of the cleaner.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. An automatic cleaner comprising:

a casing comprising a cover that defines a top surface thereof and at least one portion of an edge thereof, and a base that defines a bottom surface thereof, the cover being coupled to the base and moved relative to the base;

a sensing member installed on one of the cover and the base, and sensing a relative movement of the cover to the base;

a driving part installed on the other of the cover and the base, and operating the sensing member according to the relative movement of the cover to the base;

a buffer member installed on one of the cover and the base, and absorbing a shock according to the relative movement of the cover to the base; and a buffer member supporter supporting a bottom surface of the buffer member.

2. The automatic cleaner according to claim 1, wherein the driving part turns the sensing member on/off according to whether the cover moves relative to the base.

3. The automatic cleaner according to claim 1, wherein the sensing member and the driving part are disposed on the same line extending from a center of the casing to the edge thereof.

4. The automatic cleaner according to claim 3, wherein the sensing member is closer to the center of the casing than the driving part is.

5. The automatic cleaner according to claim 1, wherein the sensing member is closer to the edge of the casing than the buffer member is.

6. The automatic cleaner according to claim 1, further comprising a shock transmitter that is installed on the other of the cover and the base, and transmits the shock to the buffer member.

7. The automatic cleaner according to claim 6, wherein the shock transmitter selectively presses the buffer member according to whether the cover moves relative to the base.

8. The automatic cleaner according to claim 6, wherein the shock transmitter surrounds an edge of the buffer member.

9. An automatic cleaner comprising:

a cover defining a top surface thereof and one portion of an edge thereof;

a base coupled to the cover, and defining a bottom surface thereof and the other portion of the edge;

a plurality of driving parts on the cover;

a plurality of shock transmitters disposed on the cover, and farther away from an edge of the cover and the base than the driving part is;

a plurality of sensing member installation parts disposed on the base, the number of the sensing member installation parts being equal to the number of the driving parts;

a plurality of buffer member installation parts disposed on the base, the number of the buffer member installation parts being equal to the number of the shock transmitters;

a plurality of sensing members installed on the sensing member installation parts, respectively, and turned on/off by the driving parts; and a buffer member installed on the buffer member installation part, and absorbing a shock transmitted by the shock transmitter, wherein, when the cover is moved relative to the base by an external shock, the driving part turns the sensing member on/off, and the buffer member absorbs the shock from the shock transmitter.

10. The automatic cleaner according to claim 9, wherein the sensing member installation part is farther away from the edge of the cover and the base than the driving part is.

11. The automatic cleaner according to claim 9, wherein the buffer member installation part is farther away from the edge of the cover and the base than the shock transmitter is.

12. The automatic cleaner according to claim 9, wherein the buffer member installation part has a cylindrical shape with a preset length and a preset outer diameter, the buffer member has a ring shape fitted on an upper end of the buffer member installation part, and the shock transmitter has a hollow cylindrical shape surrounding the buffer member.

13. The automatic cleaner according to claim 12, wherein an outer diameter of the buffer member is equal to or smaller than an inner diameter of the shock transmitter, and an inner diameter of the buffer member is equal to or greater than a diameter of the buffer member installation part.

14. An automatic cleaner comprising:

a cover defining a top surface thereof and one portion of an edge thereof;

a base coupled to the cover, and defining a bottom surface thereof and the other portion of the edge;

a sensing member sensing a relative movement of the cover to the base; and a buffer member absorbing a shock generated by the relative movement, wherein the buffer member is formed of an elastically deformable and flexible material, and wherein the buffer member is disposed in a region in which the cover and the base are overlapped in a horizontal line.

15. The automatic cleaner according to claim 14, wherein the sensing member is installed on a sensing member installation part disposed on one of the cover and the base, and is turned on/off by a driving part disposed on the other of the cover and the base.

16. The automatic cleaner according to claim 15, wherein the sensing member installed on the sensing member installation part, and the driving part are disposed on the same virtual line, and the sensing member is farther away along the virtual line from an edge of the cover and the base than the driving part is.

17. The automatic cleaner according to claim 14, wherein the buffer member is installed on a buffer member installation part disposed on one of the cover and the base, and absorbs a shock transmitted by a shock transmitter disposed on the other of the cover and the base.

18. The automatic cleaner according to claim 17, wherein an outer diameter of the buffer member is equal to or smaller than an inner diameter of the shock transmitter, and an inner diameter of the buffer member is equal to or greater than a diameter of the buffer member installation part.

19. The automatic cleaner according to claim 17, wherein the buffer member installed on the buffer member installation part, and the shock transmitter are disposed on the same virtual line, and the buffer member is farther away along the virtual line from an edge of the cover and the base than the shock transmitter is.

* * * * *